US008845353B2

(12) United States Patent
Lin et al.

(10) Patent No.: US 8,845,353 B2
(45) Date of Patent: Sep. 30, 2014

(54) RELEASE DEVICE AND RELEASE SYSTEM AND OUTDOOR UNIT THEREOF

(75) Inventors: Yu Cheng Lin, Hsinchu (TW); Fu Yuan Huang, Hsinchu (TW)

(73) Assignee: Microelectronics Technology, Inc., Hsinchu (TW)

( * ) Notice: Subject to any disclaimer, the term of this patent is extended or adjusted under 35 U.S.C. 154(b) by 158 days.

(21) Appl. No.: 13/494,287

(22) Filed: Jun. 12, 2012

(65) Prior Publication Data

US 2013/0330954 A1 Dec. 12, 2013

(51) Int. Cl.
*H01R 4/50* (2006.01)

(52) U.S. Cl.
USPC ..... 439/344; 29/750

(58) Field of Classification Search
CPC .... H01R 43/015; H01R 43/22; H01R 43/027; H01R 23/025; H01R 13/6275; H01R 13/6272; H01R 13/6335; H01H 85/202
USPC ..... 29/750, 758, 762, 764; 439/344, 345, 439/352, 483, 832
See application file for complete search history.

(56) References Cited

U.S. PATENT DOCUMENTS 3,789,484 A * 2/1974 Morgan ..... 29/747
4,399,608 A * 8/1983 Ingaglio ..... 29/747
5,036,578 A * 8/1991 Rivera ..... 29/566.4
5,405,271 A * 4/1995 Bauer et al. ..... 439/480
7,347,129 B1 3/2008 Youtsey
7,534,128 B2 * 5/2009 Caveney et al. ..... 439/480
7,814,634 B2 * 10/2010 Francis et al. ..... 29/426.5
8,484,835 B2 * 7/2013 Wang ..... 29/764
8,517,757 B1 * 8/2013 Unger et al. ..... 439/480
2010/0323548 A1 12/2010 Daubigney

FOREIGN PATENT DOCUMENTS

EP 1693928 A2 8/2006
WO 2006047258 A1 5/2006
WO 2008069924 A2 6/2008

OTHER PUBLICATIONS

Search Report issued Sep. 7, 2012 from European counterpart application No. 12172708.5-1231 cites WO 2006047258, US 2010323548, US 7347129, WO 2008069924 and EP 1693928.

* cited by examiner

*Primary Examiner* — Thanh Tam Le
(74) *Attorney, Agent, or Firm* — WPAT, P. C.; Anthony King

(57) ABSTRACT

A release device for detaching a male plug of a cable line from a female receptacle includes a holding portion, an accommodating portion, a connecting portion and an engaging portion. The accommodating portion includes a first guiding part that is configured for alignment between the accommodating portion and the male plug. The holding portion connects to the connecting portion that connects to the accommodating portion. The accommodating portion connects to the engaging portion, which includes a concave area that is configured for engaging the male plug.

30 Claims, 11 Drawing Sheets

RELEASE DEVICE AND RELEASE SYSTEM AND OUTDOOR UNIT THEREOF

BACKGROUND

1. Technical Field

The present disclosure relates to a release device, a release system and an outdoor unit thereof, and more particularly, to a release device, a release system and an outdoor unit configured for detaching a male plug of a cable line from a female receptacle.

2. Background

The increased demand for high-speed communications has created an immediate need for broadband access to the related network infrastructure. Wireless solutions offer the benefit of ease of deployment without the requirement of road excavation to lay fiber. Wireless solutions are also less expensive compared to optical fiber and hardwired solutions.

Many wireless systems are built using point-to-point, point-to-multipoint, Local Multipoint Distribution Services (LMDS) and mesh architectures. Each link end contains an indoor unit (IDU) and an outdoor unit (ODU). The indoor unit usually has a modem and a power supply. The outdoor unit, which represents about 60% of the cost of the link, typically contains a number of subassemblies, such as a millimeter wave transmitter and receiver or an integrated transceiver, a frequency source, such as a frequency synthesizer circuit, a power supply, a controller, and monitoring circuits. Thus, the ODU is sensitive to water or humidity.

Currently, many ODUs are equipped with a waterproof cable gland to avoid the entry of water into the ODUs. As shown in FIG. 1, the cable gland 10 includes a first hollow-cylindrical portion 11, a second hollow-cylindrical portion 12, and a flange 13. Since the female receptacle 14 is accommodated inside the second hollow-cylindrical portion 12, the male plug 15 has to pass the first hollow-cylindrical portion 11 and the flange 13 to engage with the female receptacle 14. The male plug 15 includes a spring latch 16 that is latched by the upper portion 17 of the female receptacle 14 when the male plug 15 connects to the female receptacle 14.

Although the female receptacle 14 for connecting the cable line is required to be waterproof through the cable gland 10 to avoid electrical shorting due to humidity, it is difficult for a user to detach a male plug 15 of the cable line from the female receptacle 14 surrounded by the cable gland 10. To facilitate such detachment, users often utilize a tool such as a flathead screwdriver to press the spring latch 16 down so as to unlatch the male plug 15. Although the flathead screwdriver is able to unlatch the male plug 15, the darkness of the inside cable gland 10 makes it difficult for the user to locate the position of the spring latch 16.

In light of the abovementioned problems, a release device for the outdoor unit is desired.

SUMMARY

The present disclosure provides a release device that is configured for detaching a male plug of a cable line from a female receptacle. The release device includes a holding portion, an accommodating portion, a connecting portion and an engaging portion. The accommodating portion includes a first guiding part that is configured for aligning the accommodating portion toward the male plug. The connecting portion connects to the holding portion and the accommodating portion. The engaging portion connects to the accommodating portion and includes a concave area that is configured for engaging with the male plug.

The present disclosure further provides a release system that is configured for detaching a male plug of a cable line from a female receptacle. The release system includes a release device and a cable gland where the female receptacle is accommodated. The cable gland includes a first hollow-cylindrical portion, a second hollow-cylindrical portion and a flange, which connects the first hollow-cylindrical portion and the second hollow-cylindrical portion. In addition, the flange has a supporting part. The release device includes a holding portion, an accommodating portion, a connecting portion and an engaging portion. The supporting part of the flange is configured to support the accommodating portion that includes a first guiding part configured for aligning the accommodating portion toward the male plug. The connecting portion connects to the holding portion and the accommodating portion that connects to the engaging portion. The engaging portion includes a concave area configured for engaging with the male plug inside the cable gland.

The present disclosure further provides an outdoor unit that includes a housing, a printed circuit board, a female receptacle, a cable gland, and a release device. The printed circuit board is disposed in the housing and electrically connected with the female receptacle. The cable gland includes a first hollow-cylindrical portion, a second hollow-cylindrical portion and a flange, which connects the first hollow-cylindrical portion and the second hollow-cylindrical portion. The flange has a supporting part configured to connect with the release device. The release device configured for detaching a male plug of a cable line from the female receptacle includes a holding portion, an accommodating portion, a connecting portion and an engaging portion. The supporting part of the flange is configured to support the accommodating portion that includes a first guiding part configured for aligning the accommodating portion toward the male plug. The connecting portion connects to the holding portion and the accommodating portion that connects to the engaging portion. The engaging portion includes a concave area configured for engaging with the male plug inside the cable gland.

The foregoing has outlined rather broadly the features and technical benefits of the disclosure in order that the detailed description of the disclosure that follows may be better understood. Additional features and benefits of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

Figure 1:
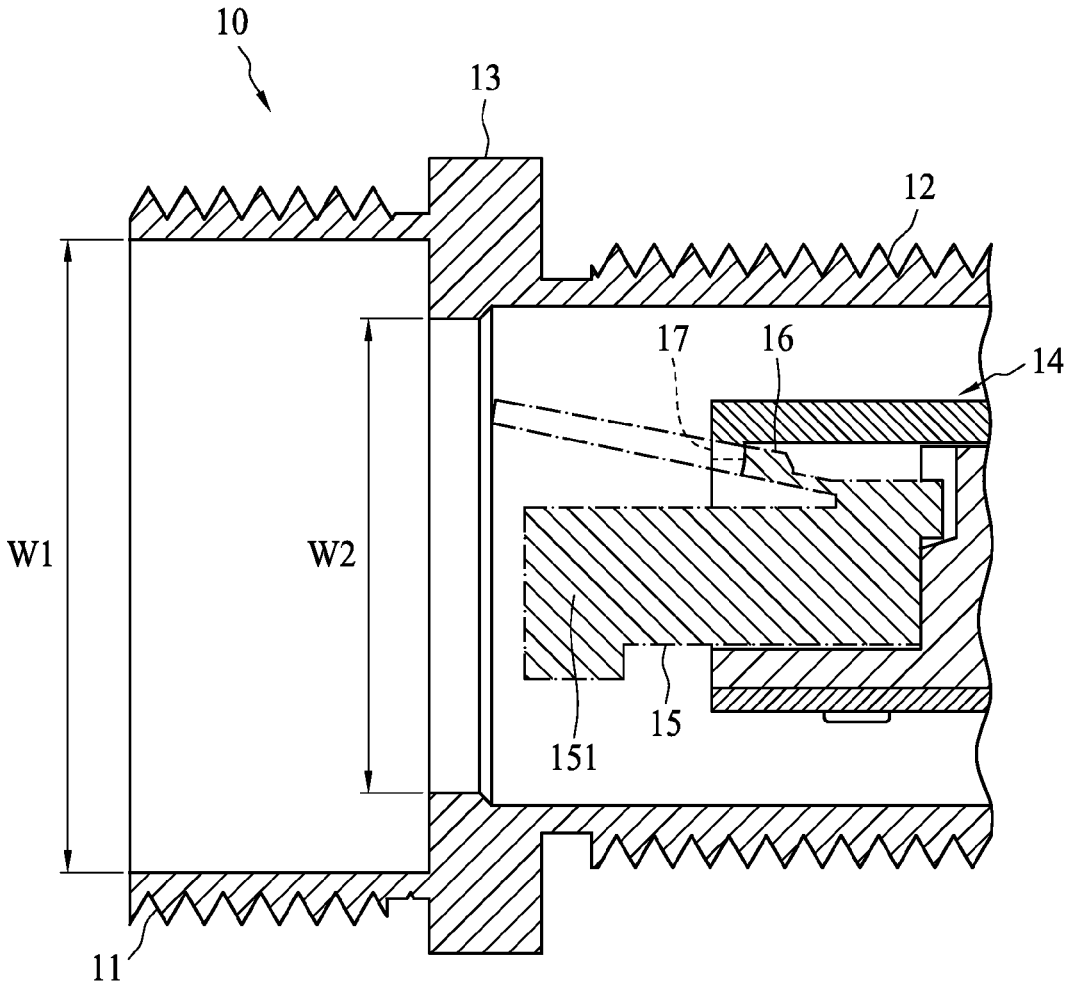
FIG. 1 (Prior Art)
FIG. 1 is a schematic view of an assembly of a cable gland, a male plug and female receptacle in accordance with a prior art.
Figure 2:
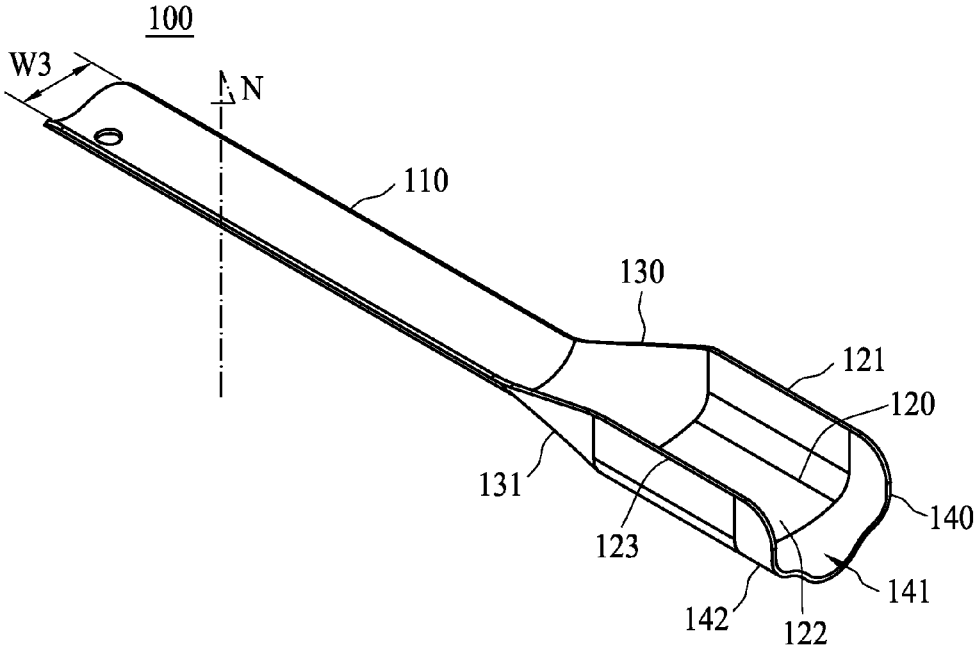
FIG. 2 is a schematic view of a release device in accordance with an embodiment of the present disclosure.
Figure 3:
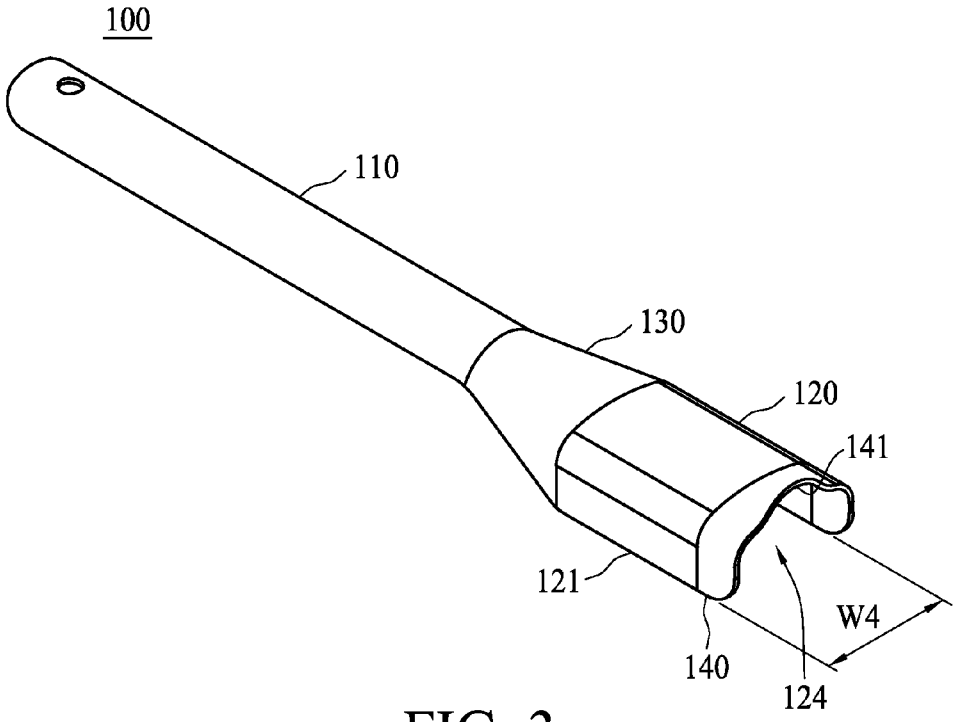
FIG. 3 is another schematic view of a release device of FIG. 2 in accordance with an embodiment of the present disclosure.
Figure 4:
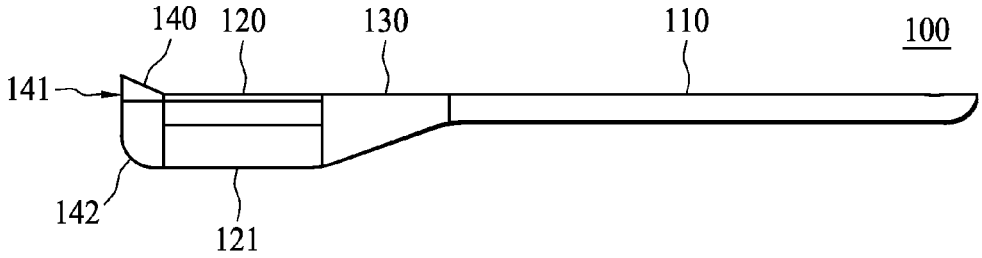
FIG. 4 is a lateral view of a release device of FIG. 2 in accordance with another embodiment of the present disclosure.

The following description of the disclosure accompanies drawings, which are incorporated in and constitute a part of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

The present disclosure is directed to a release device and a release system thereof. In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

In one embodiment shown in FIGS. 2 to 5, a release device 100 includes a holding portion 110, an accommodating portion 120, a connecting portion 130 and an engaging portion 140. The holding portion 110 is configured to be held by user who would like to use the release device 100 to detach a male plug 15 (referring to FIG. 1) from a female receptacle 14 (referring to FIG. 1). The holding portion 110 in the present embodiment has an arc-like shape; however, in other embodiments (not shown), the holding portion 110 may be a plated shape, a rod or a shape which is able to be held by the user. The width W3 of the holding portion 110 is preferably less than the width W4 of the accommodating portion 120; however, in another embodiment (not shown), the width W3 of the holding portion 110 may be designed to be the same as the width W4 of the accommodating portion 120. Moreover, in other embodiments (not shown), to allow the user hold the holding portion 110 in a more stable manner, the width W3 of the holding portion 110 may be designed to be greater than the width W4 of the accommodating portion 120.

The accommodating portion 120 includes a first guiding part 121 that is configured to align the accommodating portion 120 toward the male plug 15 (referring to FIG. 1). The first guiding part 121 is configured to extend in a direction, which is approximately parallel to the normal direction N of the holding portion 120. In other words, the first guiding part 121 extends in the direction, which is approximately perpendicular to an inner surface 122 of the accommodating portion 120. In the present embodiment, the accommodating portion 120 includes the first guiding part 121 and a second guiding part 123, which extends in the extending direction of the first guiding part 121. In other words, the second guiding part 123 extends parallel to the first guiding part 121. Consequently, the first guiding part 121 and second guiding part 123 define a space 124 that is configured for accommodating the male plug 15, which is engaged in the female receptacle 14 (referring to FIG. 1). Therefore, the guiding parts 121 and 123 are configured for aligning the accommodating portion 120 toward the male plug 15.

In the present embodiment shown in FIGS. 2 to 5, the connecting portion 130 connects to the holding portion 110 and the accommodating portion 120. In other words, the accommodating portion 120 directly links to the connecting portion 130 that directly links to the holding portion 110, which connects to the accommodating portion 120 through the connecting portion 130. Since the holding portion 110 has a same horizontal level as the accommodating portion 120 shown in FIG. 4, the connecting portion 130 does not require bending for connecting the holding portion 110 and the accommodating portion 120. However, in another embodiment (not shown), the connecting portion 130 may bend when the holding portion 110 and the accommodating portion 120 are positioned at different horizontal levels. Furthermore, the connecting portion 130 further includes a stabilizing part 131, which connects to the guiding parts 121 and 123. The stabilizing part 131 is configured to reinforce the structure of the guiding parts 121 and 123 so as to maintain the space 124 accommodating the male plug 15 (referring to FIG. 1).

Figure 5:
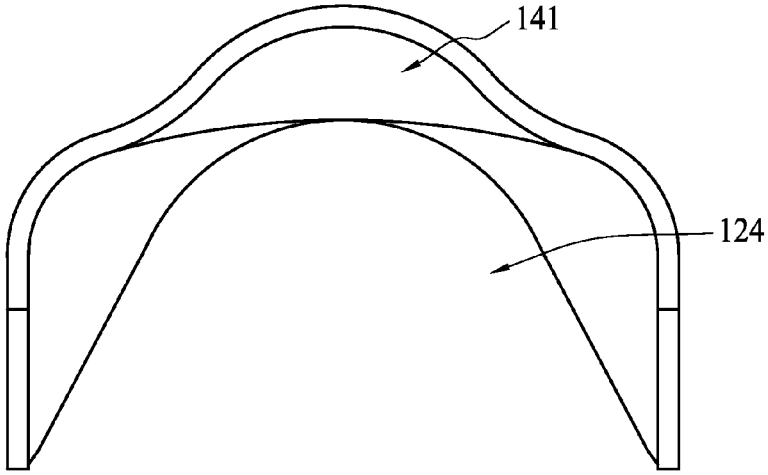
FIG. 5 is a front view of a release device of FIG. 2 in accordance with another embodiment of the present disclosure.

In the present embodiment shown in FIGS. 2 to 5, the engaging portion 140 connects to the accommodating portion 120 and includes a concave area 141 as shown in FIG. 5. The concave area 141 is indented in a direction opposite to the extending direction N of the first guiding part 121. Furthermore, the engaging portion 140 further includes a fixing part 142, which is configured to reinforce the structure of guiding parts 121 and 123 so as to maintain the space 124 accommodating the male plug 15 (referring to FIG. 1). However, in another embodiment (not shown), if the strength of the guiding parts 121 and 123 is sufficient, the engaging portion 140 does not need any further fixing parts 142.

Since the width W3 of the holding portion 110 and the width W4 of the accommodating portion 120 are less than the width W2 of the opening of the flange 13 and the width W1 of the opening of the first hollow-cylindrical portion 11(referring to FIG. 1), the release device 100 can easily pass through the opening to engage with the male plug 15. As shown in FIG. 1, the male plug 15 includes two opposite side walls 151. Since the width W4 of the accommodating portion 120 is approximately the same as the width of the male plug 15 (referring to FIG. 1), the first guiding part 121 and the second guiding part 123 contact with two opposite side walls 151. In other words, the first guiding part 121 and the second guiding part 123 can guide the release device 100 to find where the male plug 15 and the female receptacle 14 are located. As shown in FIGS. 1 to 5, when the male plug 15 is accommodated in the space 124 and the guiding parts 121 and 123 contact the opposite side walls 151, the concave area 141 of the engaging portion 140 is configured to engage with the male plug 15. More particularly, after the guiding parts 121 and 123 cramp the male plug 15 and the concave area 141 of the engaging portion 140 accommodates the spring latch 16, the release device 100 may be pressed in a direction toward the bottom of male plug 15 or the cable line (not shown) so as to release the spring latch 16 from the upper portion 17 of the female receptacle 14 and thus unlatch the male plug 15.

Figure 6:
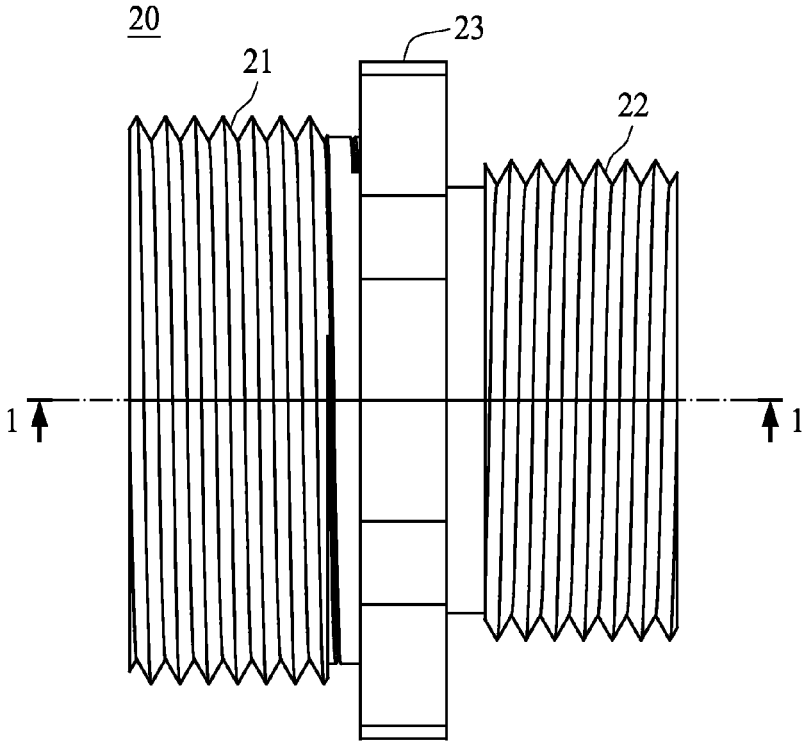
FIG. 6 is a schematic view of a cable gland in accordance with another embodiment of the present disclosure.

As shown in FIG. 6, a cable gland 20 includes a first external thread 21, a second external thread 22 and a flange 23 that may be, but is not limited to, a hexagonal shape. Thus, the external hexagonal flange 23 is configured for rotation of the cable gland 20. In other words, the cable gland 20 has the external hexagonal flange 23 for engagement by a spanner or like tool to rotate the cable gland 20 for assembly and installation thereof.

Figure 7:
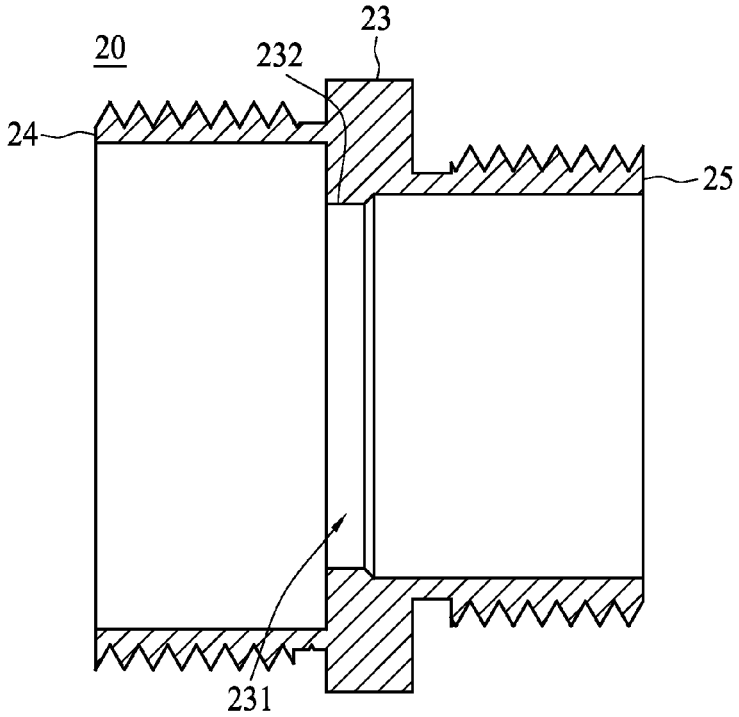
FIG. 7 is a cross-sectional view of the cable gland of FIG. 6 in accordance with another embodiment of the present disclosure.

FIG. 7 is a cross-sectional view of the cable gland shown in FIG. 6 along the cross-sectional line 1-1. As shown in FIG. 7, the cable gland 20 includes a first hollow-cylindrical portion 24, a second hollow-cylindrical portion 25 and a flange 23 that connects the first hollow-cylindrical portion 24 and the second hollow-cylindrical portion 25. Since the first hollow cylindrical portion 24, a second hollow-cylindrical portion 25 and a flange 23 are integrated, the first hollow cylindrical portion 24, a second hollow-cylindrical portion 25 and a flange 23 can be rotated in the same direction. When the flange 23 is rotated by a spanner (not shown), the second hollow-cylindrical portion 25 having the second external thread 22 may be configured to screw into the ODU or to engage the ODU. In addition, the first hollow cylindrical portion 24 also has the first external thread 21, which is configured to screw or engage a waterproof cap (not shown) so as to prevent water or humidity from entering the ODU.

Figure 8:
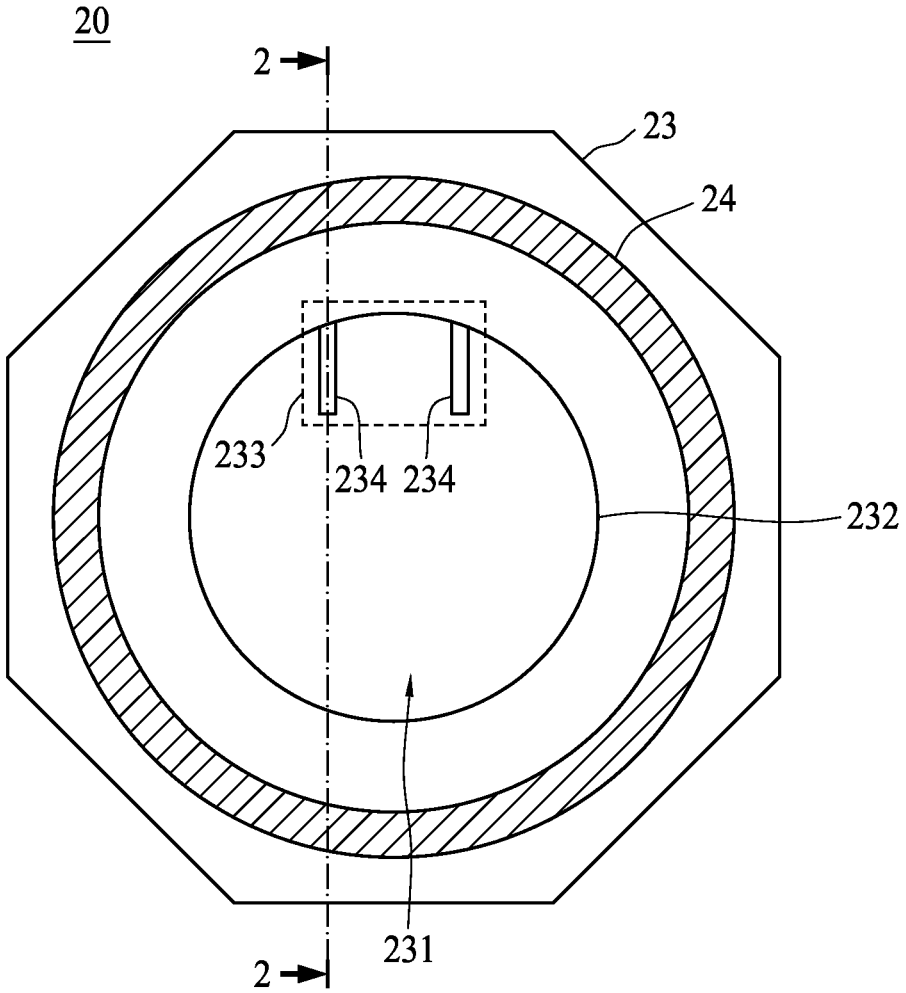
FIG. 8 is a front view of the cable gland of FIG. 6 in accordance with another embodiment of the present disclosure.
Figure 9:
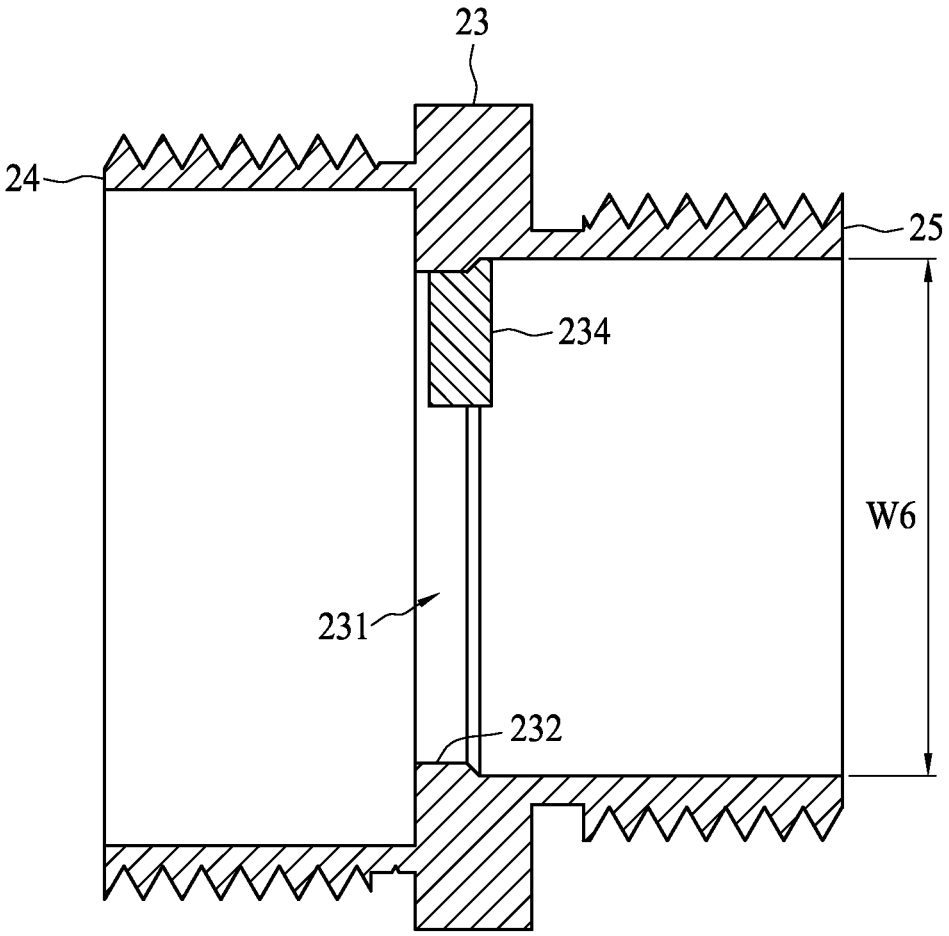
FIG. 9 is a cross-sectional view of the cable gland of FIG. 8 in accordance with another embodiment of the present disclosure.
Figure 10:
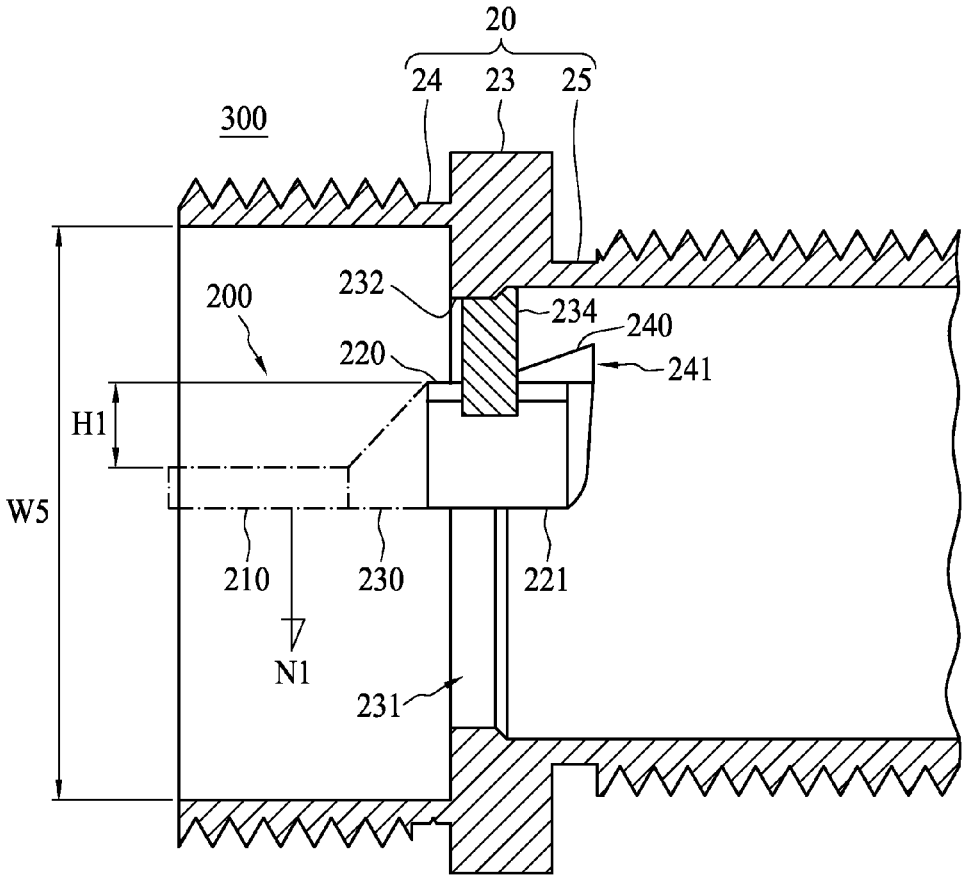
FIG. 10 is a cross-sectional view of an assembly of a cable gland, a release device and protruding ribs in accordance with another embodiment of the present disclosure.

FIG. 8 is a front view of the cable gland shown in FIG. 6. Referring to FIGS. 6 to 8, the flange 23 has a central opening 231 that is defined by an inner wall 232. The flange 23 further has a supporting part 233, which is protruded from the inner wall 232 toward the central opening 231. FIG. 9 is a cross-sectional view of FIG. 8 along the cross-sectional line 2-2. The supporting part 233 is configured to support the accommodating portion 220 as shown in FIG. 10. In the present embodiment, the supporting part 233 includes at least one protruding rib 234 that connects to the accommodating portion 220. However, in another embodiment (not shown), the supporting part 233 may comprise another mechanism which provides similar function for supporting the accommodating portion 220. In particular, the pair of the protruding ribs 234 is connected to the accommodating portion 220 of the release device 200 by screws or other mechanism that allows the accommodating portion 220 to pivot relative to the protruding rib 234.

As shown in FIG. 10, a release system 300 includes a cable gland 20 and a release device 200. The release device 200 includes a holding portion 210, the accommodating portion 220, a connecting portion 230 and an engaging portion 240. In the present disclosure, the first hollow-cylindrical portion 24 has an opening with first width W5, while the second hollow-cylindrical portion 25 has an opening with second width W6. Since the first width W5 is greater than the second width W6, the male plug 9 (referring to FIG. 11) can easily pass through the first hollow-cylindrical portion 24 and the release device 200 supported by the supporting part 233 to engage with the female receptacle 8 located in the second hollow-cylindrical portion 25. Thus, the male plug 9 also easily passes through the holding portion 210, the accommodating portion 220, a connecting portion 230 and an engaging portion 240 to engage with the female receptacle 8 (referring to FIG. 11).

Figure 11:
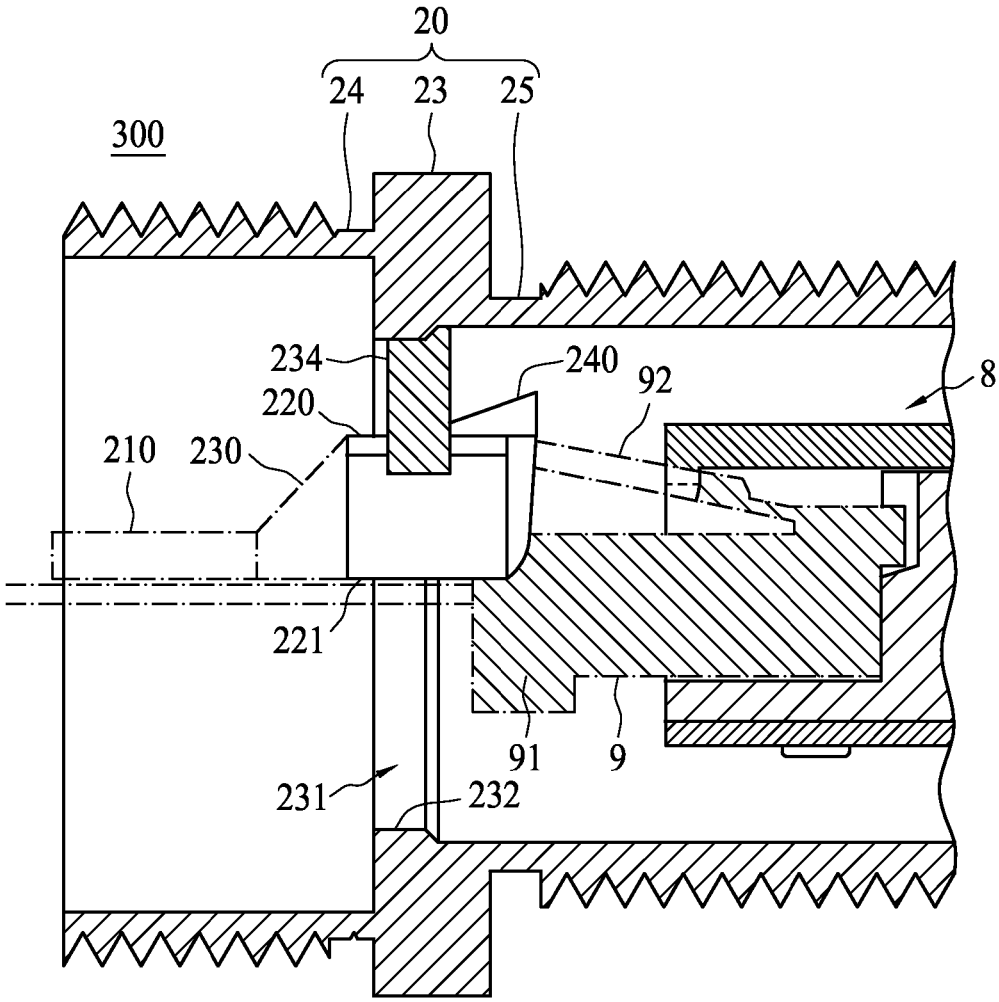
FIG. 11 is a cross-sectional view of a release system in accordance with another embodiment of the present disclosure.

As shown in FIGS. 10 and 11, the accommodating portion 220 includes a first guiding part 221 that is configured for aligning the accommodating portion 220 toward the male plug 9. In particular, the first guiding part 221 is configured to extend in a direction approximately parallel to the normal direction N1 of the holding portion 210. In other words, the first guiding part 221 protrudes toward the central opening 231 from the accommodating portion 220. The male plug 9 includes two opposite side walls 91. Since the first guiding part 221 can contact one of the opposite side walls 91, the first guiding part 221 can guide the release device 200 to find where the male plug 9 and the female receptacle 8 are located so that first guiding part 221 can assist in aligning the accommodating portion 220 toward the male plug 9 or the female receptacle 8.

In another embodiment (not shown), the accommodating portion 220 further includes a second guiding part (not shown) extending in the same direction as the first guiding part 221. In other words, the second guiding part extends in the extending direction of the first guiding part 221. Moreover, the first guiding part 221 and the second guiding part can define a space configured for accommodating the male plug 9. In addition, the first guiding part 221 and the second guiding part may contact two opposite side walls 91 so as to accommodate the male plug 9 and to locate where the male plug 9 and the female receptacle 8 are located. Particularly, after the release system 300 is screwed into the ODU (not shown) having a female receptacle 8 and the male plug 9 passes through the central opening 231 to engage with the female receptacle 8, the accommodating portion 220 of the release device 200 can accommodate or locate the male plug 9 so as to align the accommodating portion 220 toward the male plug 9.

In the present embodiment shown in FIGS. 10 and 11, the connecting portion 230 connects to the holding portion 210 and the accommodating portion 220. In other words, the accommodating portion 220 directly links to the connecting portion 230 that directly links to the holding portion 210. In the present embodiment, since the horizontal level of the holding portion 210 and the horizontal level of the accommodating portion 220 are different, the connecting portion 230 has to bend for connecting the holding portion 210 and the accommodating portion 220. In other words, the connecting portion 230 can bend to connect with the holding portion 210 and the accommodating portion 220, when a horizontal difference H1 between the holding portion 210 and the accommodating portion 220 exists. The width of the holding portion 210 is preferably less than the width of the accommodating portion 220; however, in another embodiment (not shown), the width of the holding portion 210 may be designed to be the same as the width of the accommodating portion 220. Moreover, in other embodiments (not shown), to allow the user to hold the holding portion 210 in a more stable manner, the width of the holding portion 210 may be designed to be greater than the width of the accommodating portion 220.

In the present embodiment shown in FIGS. 10 and 11, the engaging portion 240 connects to the accommodating portion 220 and includes a concave area 241 that is indented in a direction opposite to the extending direction N1 of the first guiding part 221. After the male plug 9 engages with the female receptacle 8 and the guiding parts 221 cramp the male plug 15, the concave area 241 of the engaging portion 240 may contact or accommodate the spring latch 92. In other words, the engaging portion 240 is configured for engaging with the spring latch 92 of the male plug 9.

Figure 12:
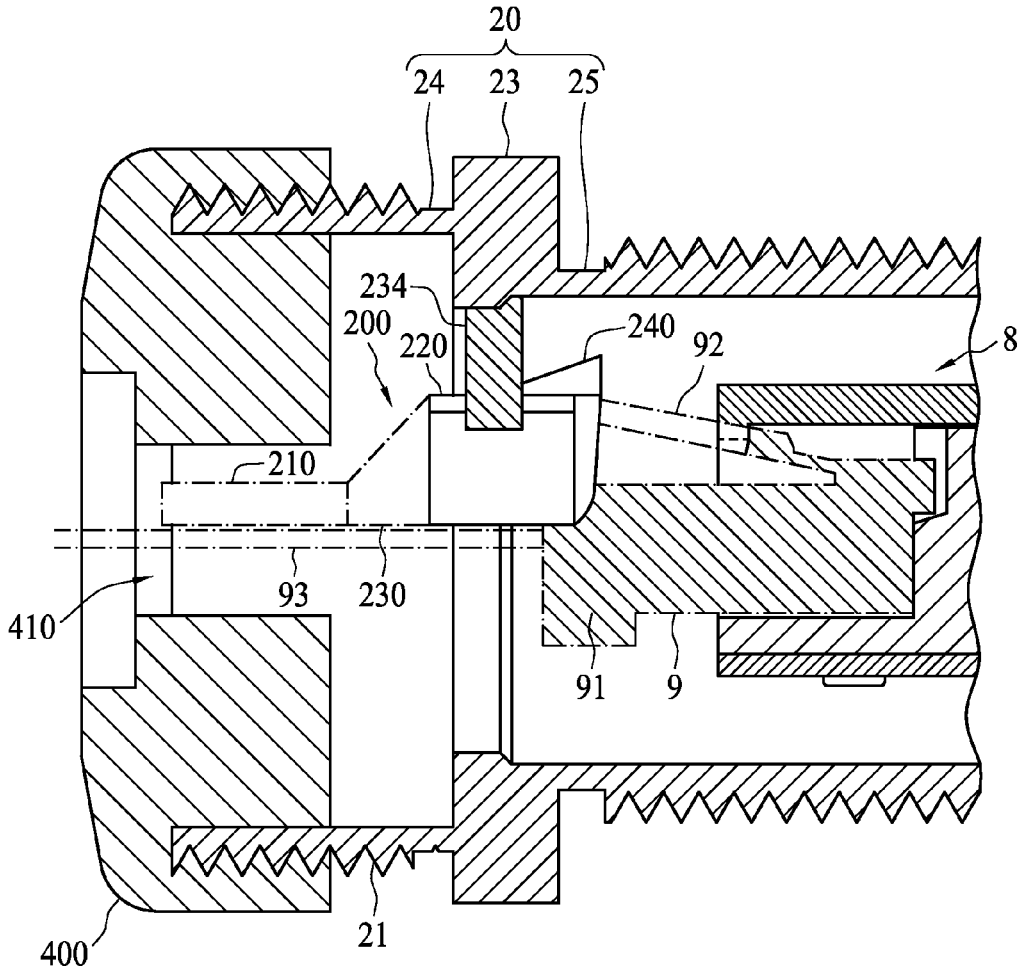
FIG. 12 is a cross-sectional view of a release system and a waterproof cap in accordance with another embodiment of the present disclosure.

As shown in FIG. 12, a waterproof cap 400 having an internal thread is screwed with the first external thread 21 of the first hollow-cylindrical portion 24 to move along the axis of the waterproof cap 400. The waterproof cap 400 having a hole 410 can prevent the entry of water or humidity into the ODU. The hole 410 allows the cable line 93 of the male plug 9 to pass through. Moreover, the hole 410 also can accommodate the holding portion 210 of the release device 200.

Figure 13:
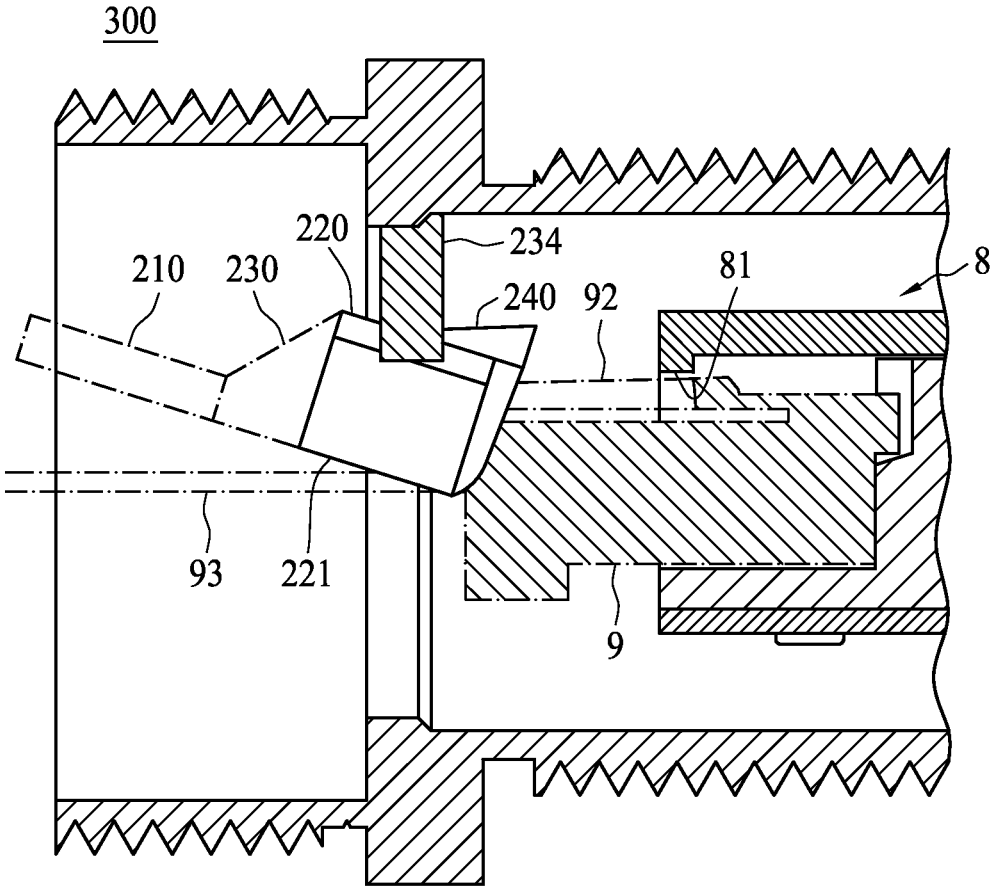
FIG. 13 is a cross-sectional view of a release device of the release system pivoting to unlatch the male plug in accordance with another embodiment of the present disclosure.

When the user wishes to remove the cable line 93, the waterproof cap 400 can be removed from the first hollow-cylindrical portion 24 as shown in FIG. 13. Referring to FIGS. 11 to 13, since the protruding ribs 234 allows the release device 200 to pivot thereon, the release device 200 pivotally connects to the protruding ribs 234 to cause the release device 200 to pivot between a closed position (referring to FIG. 11) and a detached position (referring to FIG. 13). When the release device 200 pivots toward the detached position, the concave area 241 of the engaging portion 240 may press the spring latch 92 downward so as to unlatch the male plug 9. Once the spring latch 92 is unlatched away from the upper portion 81 of the female receptacle 8, the male plug 9 and cable line 93 can be pulled out from the female receptacle 8. In summary, the release system 300 is configured for detaching the male plug 9 of the cable line 93 from the female receptacle 8. In addition, the release system 300 can easily find where the male plug 9 and the spring latch 92 are located so as to conveniently unlatch the spring latch 92 without other devices which help the user find the location of the spring latch 92 inside the dark cable gland 20.

Figure 14:
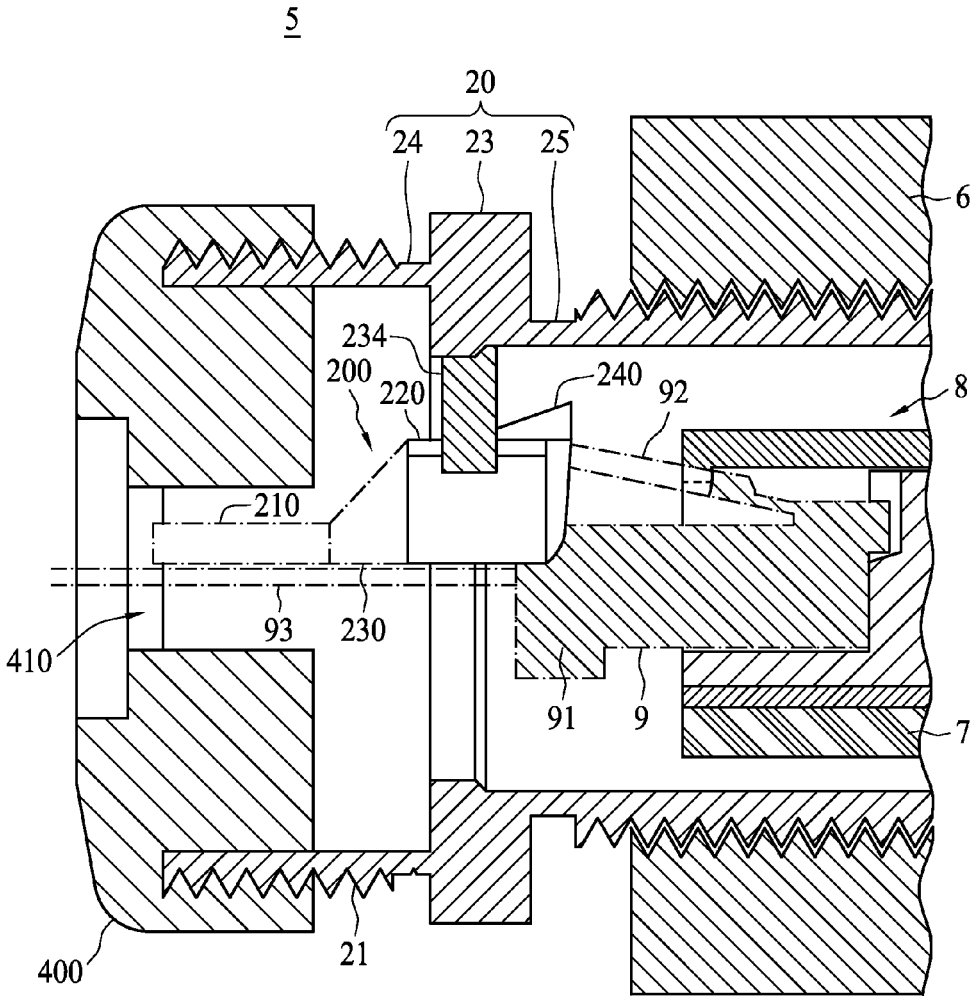
FIG. 14 is a cross-sectional view of an outdoor unit in accordance with another embodiment of the present disclosure.

As shown in FIG. 14, an outdoor unit 5 includes a housing 6, a printed circuit board 7 disposed in the housing 6, a female receptacle 8 electrically connecting with the printed circuit board 7, a cable gland 20 and a release device 200. The cable gland 20 includes a first hollow-cylindrical portion 24, a second hollow-cylindrical portion 25, and a flange 23. The flange 23 connecting with the first hollow-cylindrical portion 24 and the second hollow-cylindrical portion 25 has a supporting part 233 (referring to FIG. 8). The release device 200 is configured for detaching a male plug 9 of a cable line 93 from the female receptacle 8. The release device 200 includes a holding portion 210, an accommodating portion 220, a connecting portion 230 and an engaging portion 240. The accommodating portion 220 includes a first guiding part 221 (referring to FIG. 10) that is configured for aligning the accommodating portion 220 toward the male plug. In particular, the supporting part 233 is configured to support the accommodating portion 220. The connecting portion 230 connects with the holding portion 210 and the accommodating portion 220. The engaging portion 240 connects to the accommodating portion 220 and includes a concave area 241 (referring to FIG. 10) that is configured for engaging with the spring latch 92 of the male plug 9 so as to unlatch the male plug 9 from the female receptacle 8.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, and composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A release device for detaching a male plug of a cable line, comprising:

a holding portion disposed on a first end of the release device;

an accommodating portion, including a first guiding part extended upwardly from the accommodating portion and configured for aligning the accommodating portion toward the male plug;

a connecting portion connecting with the holding portion and the accommodating portion; and an engaging portion connecting to the accommodating portion and is configured for engaging with the male plug, wherein the engaging portion is configured to form a concave area which is indented in a downward direction opposite to an extending direction of the first guide part for engaging with a latch of the male plug, and the engaging portion is configured to extend forward to a second end the release device.

2. The release device according to claim 1, wherein a width of the holding portion is less than a width of the accommodating portion.

3. The release device according to claim 1, wherein the first guiding part is configured to extend in a direction approximately parallel to a normal direction of the holding portion.

4. The release device according to claim 3, wherein the accommodating portion further includes a second guiding part, extending in the extending direction of the first guiding part.

5. The release device according to claim 4, wherein the first guiding part and the second guiding part define a space configured for accommodating the male plug.

6. The release device according to claim 5, wherein the male plug includes two opposite side walls, and the first guiding part and the second guiding part contact with the two opposite side walls, respectively.

7. A release system for detaching a male plug of a cable line, comprising:

a cable gland including:

a first hollow-cylindrical portion;

a second hollow-cylindrical portion; and a flange connecting the first hollow-cylindrical portion and the second hollow-cylindrical portion and having a supporting part; and a release device including:

a holding portion disposed on a first end of the release device;

an accommodating portion including a first guiding part extended upwardly from the accommodating portion and configured for aligning the accommodating portion toward the male plug, wherein the supporting part is configured to support the accommodating portion;

a connecting portion connecting with the holding portion and the accommodating portion; and an engaging portion connecting to the accommodating portion and is configured for engaging with the male plug, wherein the engaging portion is configured to form a concave area which is indented in a downward direction opposite to an extending direction of the first guide part for engaging with a latch of the male plug, and the engaging portion is configured to extend forward to a second end the release device.

8. The release system according to claim 7, wherein a width of the holding portion is less than a width of the accommodating portion.

9. The release system according to claim 7, wherein the first guiding part is configured to extend in a direction approximately parallel to a normal direction of the holding portion.

10. The release system according to claim 9, wherein the accommodating portion further includes a second guiding part, extending in the extending direction of the first guiding part.

11. The release system according to claim 10, wherein the first guiding part and the second guiding part define a space configured for accommodating the male plug.

12. The release system according to claim 11, wherein the male plug includes two opposite side walls, and the first guiding part and the second guiding part contact the two opposite side walls, respectively.

13. The release system according to claim 7, wherein the first hollow-cylindrical portion has an opening with first width, the second hollow-cylindrical portion has an opening with second width, and the first width is greater than the second width.

14. The release system according to claim 7, wherein the supporting part includes at least one protruding rib connecting with the accommodating portion.

15. The release system according to claim 14, wherein the release device pivotally connects to the protruding rib to cause the release device to pivot between a closed position and a detached position.

16. The release system according to claim 7, wherein the first hollow-cylindrical portion has a first external thread configured to engage a waterproof cap.

17. The release system according to claim 7, wherein the second hollow-cylindrical portion has a second external thread configured to engage an outdoor unit.

18. The release system according to claim 7, wherein the flange is an external hexagonal flange configured for rotation of the cable gland.

19. An outdoor unit, comprising:

a housing;

a printed circuit board disposed in the housing;

a female receptacle electrically connecting with the printed circuit board;

a cable gland including:

a first hollow-cylindrical portion;

a second hollow-cylindrical portion; and a flange connecting the first hollow-cylindrical portion and the second hollow-cylindrical portion and having a supporting part; and a release device configured for detaching a male plug of a cable line from the female receptacle, the release device including:

a holding portion disposed on a first end of the release device;

an accommodating portion including a first guiding part extended upwardly from the accommodating portion and configured for aligning the accommodating portion toward the male plug, wherein the supporting part is configured to support the accommodating portion;

a connecting portion connecting with the holding portion and the accommodating portion; and an engaging portion connecting to the accommodating portion and is configured for engaging with the male plug, wherein the engaging portion is configured to form a concave area which is indented in a downward direction opposite to an extending direction of the first guide part for engaging with a latch of the male plug, and the engaging portion is configured to extend forward to a second end the release device.

20. The outdoor unit according to claim 19, wherein a width of the holding portion is less than a width of the accommodating portion.

21. The outdoor unit according to claim 19, wherein the first guiding part is configured to extend in a direction approximately parallel to a normal direction of the holding portion.

22. The outdoor unit according to claim 21, wherein the accommodating portion further includes a second guiding part, extending in the extending direction of the first guiding part.

23. The outdoor unit according to claim 22, wherein the first guiding part and the second guiding part define a space configured for accommodating the male plug.

24. The outdoor unit according to claim 23, wherein the male plug includes two opposite side walls, and the first guiding part and the second guiding part contact the two opposite side walls, respectively.

25. The outdoor unit according to claim 19, wherein the first hollow-cylindrical portion has an opening with first width, the second hollow-cylindrical portion has an opening with second width, and the first width is greater than the second width.

26. The outdoor unit according to claim 19, wherein the supporting part includes at least one protruding rib connecting with the accommodating portion.

27. The outdoor unit according to claim 26, wherein the release device pivotally connects to the protruding rib to cause the release device to pivot between a closed position and a detached position.

28. The outdoor unit according to claim 19, wherein the first hollow-cylindrical portion has a first external thread configured to engage a waterproof cap.

29. The outdoor unit according to claim 19, wherein the second hollow-cylindrical portion has a second external thread configured to engage an outdoor unit.

30. The outdoor unit according to claim 19, wherein the flange is an external hexagonal flange configured for rotation of the cable gland.

* * * * *